United States Patent [19]

Hirano et al.

[11] Patent Number: 4,666,380

[45] Date of Patent: May 19, 1987

[54] SCROLL TYPE FLUID MACHINE WITH PREVENTION OF STRESS CONCENTRATION

[75] Inventors: Takahisa Hirano; Shoji Fukami; Yasuharu Maruiwa, all of Nagoya; Takuyuki Itoh; Tamio Sugimoto, both of Nishikasugai; Tetsuo Ono, Nagoya; Masatoshi Mukai, Nishikasugai, all of Japan

[73] Assignee: Mitsubishi Jukogyo Kabushiki Kaisha, Japan

[21] Appl. No.: 745,393

[22] Filed: Jun. 14, 1985

[30] Foreign Application Priority Data

| | | | |
|---|---|---|---|
| Jun. 18, 1984 | [JP] | Japan | 59-89324[U] |
| Sep. 26, 1984 | [JP] | Japan | 59-144242[U] |
| Nov. 27, 1984 | [JP] | Japan | 59-248698 |
| Jan. 17, 1985 | [JP] | Japan | 60-3607[U] |
| Feb. 21, 1985 | [JP] | Japan | 60-22541[U] |

[51] Int. Cl.[4] ..... F01C 1/04; F01C 21/08; B23P 9/04; B23P 15/00

[52] U.S. Cl. ..... 418/55; 418/150; 29/156.4 R

[58] Field of Search ..... 418/55, 150; 29/156.4 R, 527.6, 557; 416/185, 244 A

[56] References Cited

U.S. PATENT DOCUMENTS

| | | | |
|---|---|---|---|
| 4,490,099 | 12/1984 | Terauchi et al. | 418/55 |
| 4,547,137 | 10/1985 | Terauchi et al. | 418/55 |
| 4,594,061 | 6/1986 | Terauchi | 418/55 |

FOREIGN PATENT DOCUMENTS

| | | | |
|---|---|---|---|
| 57-148085 | 9/1982 | Japan | 418/55 |

*Primary Examiner*—John J. Vrablik
*Attorney, Agent, or Firm*—McGlew and Tuttle

[57] ABSTRACT

A scroll type fluid machine comprising a pair of mutually engaged scroll members each including a side plate and a spiral lap uprightly disposed on an inside surface of the side plate; when the scroll members are relatively resolved in solar motion relationship, a fluid volume in sealed chambers defined by the pair of engaged scroll members being varied, so that a pressure of the fluid in the sealed chambers is thereby varied in order to discharge a gas therefrom, characterized by constituting so that stress may not concentrate at stress concentration portions of the scroll members, i.e., at corners of inner end base portions of the laps and the inside surfaces of the side plates in an eddy center section of the scroll members; and a method for forming the scroll members which permit improving productivity, characterized by forming, at the stress concentration portion of each scroll member, a round having a relatively large curvature radius which is enough to provide it with fatigue strength, and then finishing a relatively small round by means of a cutter for finish working.

5 Claims, 25 Drawing Figures

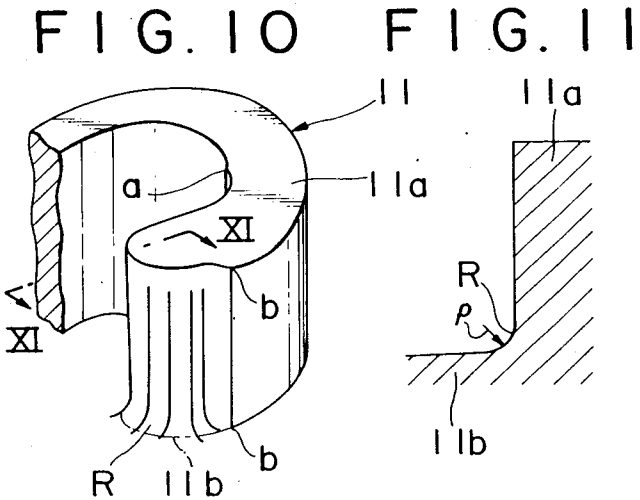
FIG. 10
FIG. 11
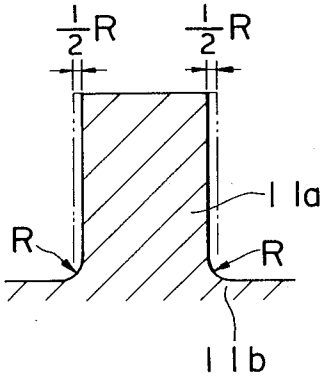
FIG. 9
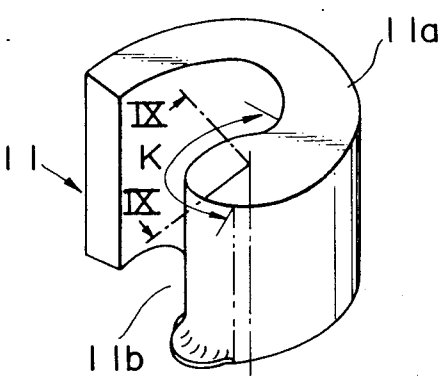
FIG. 8
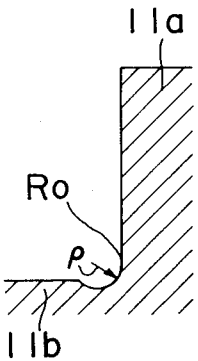
FIG. 13
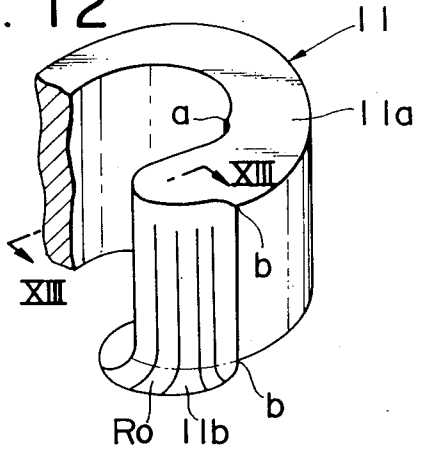
FIG. 12
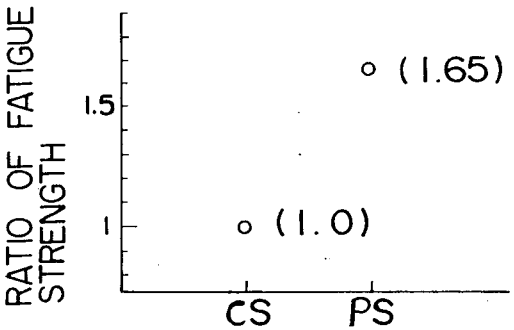
FIG. 14

SCROLL TYPE FLUID MACHINE WITH PREVENTION OF STRESS CONCENTRATION

BACKGROUND OF THE INVENTION (i) Field of the Invention

The present invention relates to a scroll type fluid machine which can be employed as a compressor, an expanding machine, an electric motor or the like, and to a method for molding scroll members used in the fluid machine.

(ii) Description of the Prior Art

FIGS. 19 and 20 (which is a sectional view taken along the line XX—XX in FIG. 19) of accompanying drawings show one embodiment of a scroll body in a conventional scroll type compressor. A pair of scroll bodies 01, 02 are engaged with each other, with their laps 01*a*, 02*a* deviating from each other in phase as much as an angle of 180°, and with tip ends 01*c*, 02*c* of the laps 01*a*, 02*a* closely contacting with inside surfaces 01*d*, 02*d* of side plates 01*b*, 02*b*. In consequence, when both the scroll bodies are revolved relatively, fluid volumes in sealed chambers 03, 04 defined by the pair of engaged scroll bodies 01, 02 will be reduced gradually while they are moved toward their center, in order to compress a gas in the chambers 03, 04 and to then discharge it through a discharge opening 05 at the central position of the machine.

Techniques for manufacturing this type of scroll members 01, 02 can be classified into two methods. One of them comprises separately preparing the side plates and the laps, and then combining both to each other. Another method comprises simultaneously and integrally preparing the side plates and the laps. In the case of the former method, the technique of fixing the laps to the side plates is less reliable and a working accuracy is also insufficient, and thus the side plates and the laps, after their fixation, must be finally finished on all of their surfaces which will be in contact with the partner scroll. For this reason, the method in which the scroll members 01, 02 are integrally and simultagenously formed has heretofore been employed.

However, the conventional integral type of fluid machine takes the system that the gas in the sealed chambers 03, 04 is airtightly retained, therefore as shown enlargedly in FIG. 21, angular portions at the corner of base portions of the laps 01*a*, 02*a* and inside surfaces 01*d*, 02*d* of the side plates 01*b*, 02*b* cannot be rounded and have right angles. As a result, stress will concentrate at these angular corner portions, and the base portions of the laps 01*a*, 02*a* will be poor in strength, depending upon a height of the laps 01*a*, 02*a* and compressive conditions. Further, a repeated application of an engaging force between the laps 01*a*, 02*a* and/or a pressure of the gas in the sealed chambers 03, 04 will lead to the occurrence of cracks and breakage troubles. It can thus be appreciated that the conventional integral method possesses no satisfactory reliability.

The pressure of the gas in the sealed chambers 03, 04 becomes higher as the sealed chambers 03, 04 approach the center of the spiral laps, and it is to be noted that the siffness of the spiral laps 01*a*, 02*a* is smaller at their inner end portions, i.e., at their central portions than at other portions thereof. In most cases, accordingly, cracks and breakage troubles have appeared at a base of an inner end portion (at an end in the center of a spiral eddy) of each lap 01*a* or 02*a*, as shown by an arrow in FIG. 23.

If an attempt is made to round the angular portions $A_2$ at the corners of the bases of the laps 01*a*, 02*a* and the inside surfaces 01*d*, 02*d* of the side plates 01*b*, 02*b* on condition that the gas in the sealed chambers 03, 04 is airtightly retained, a constitution in FIG. 22 can be conceived.

Moreover, as in FIG. 22, if it is contemplated to round the angular portion at the base corner $A_2$ of the lap 01*a* of the scroll members 01 and the inside surface 01*b* of the side plate 01*b*, the respective laps 01*a*, 02*a* of the pair of scroll members 01, 02 must also be rounded on their tip portions $B_2$ in order to prevent the angular portion $A_2$ from contacting with the tip portion of the lap 02*a* of the partner scroll member 02.

In short, it is necessary to round off, in the same shape, the angular portions $A_2$ at the corners of the laps 01*a*, 02*a* and the side plates 01*b*, 02*b* of both the scroll members 01, 02 as well as the tip portions $B_2$ of the corresponding laps 01*a*, 02*a*.

In order to obtain such a structure, an extremely intricate working will be required and costs of the mechanical working will increase noticeably. For this reason, such a constitution can be designed only on a desk, but has not been put into practice.

SUMMARY OF THE INVENTION

The present invention has now been achieved in view of the above-mentioned situations.

An object of the present invention is to provide a scroll type fluid machine and a method for forming scroll members used therein, and according to the present invention, it can be accomplished to protect, from cracks and breakage troubles, angular portions at the corners of inner end base portions of laps and inside surfaces of side plates in the eddy center of spiral scroll members.

For the achievement of the above-mentioned object, the present invention comprises the following gists:

(I) A scroll type fluid machine comprising a pair of mutually engaged scroll members each including a side plate and a spiral lap uprightly disposed on an inside surface of the side plate; when the scroll members are relatively revolved, in solar motion relationship, fluid volumes in sealed chambers defined by the pair of engaged scroll members being varied, so that a pressure of the fluid in the sealed chambers is thereby varied in order to discharge a gas therefrom, characterized by:

(i) constituting so that stress may not concentrate at corners of inner end base portions of the laps of the scroll members and the inside surfaces of the side plates, and (ii) the scroll members which are prepared by blowing, on rounds each having a curvature radius $\rho$ at the corners of the inner end base portions of the laps and the inside surfaces of the side plates of the scroll members, solid grains each having a smaller diameter than the above-mentioned curvature radius $\rho$, and mechanically finishing portions of the laps and the side plates other than the portions on which the solid grains have been blown.

(II) A method for forming scroll members used in a scroll type fluid machine comprising a pair of engaged scroll members each including a side plate and a spiral lap uprightly disposed on an inside surface of the side plate; when the scroll members are relatively revolved in solar motion relationship, fluid volumes in sealed chambers defined by the pair of engaged scroll members being varied, so that a pressure of the fluid in the sealed chambers is thereby varied in order to discharge a gas therefrom, the method being characterized by roughly working each corner of an inner end base portion of the lap and the inside surface of the side plate of the scroll member so as to form a complete round having a relatively large curvature radius which is enough to provide the lap with fatigue strength, by the use of a cutter, and finishing, at each corner portion, a round having a relatively small curvature radius which does not contact with a tip end portion of the lap of the partner scroll member, by the use of a cutter.

The fluid machine according to the present invention has the above-mentioned constitution, and effects in the following paragraphs (I) (i) and (ii) as well as (II) can be obtained:

(I) (i) Since the fluid machine is constructed so that stress may not concentrate at each corner of the inside end base portion of the lap and the inside surface of the side plate of the scroll member, the occurrence of cracks and breakage troubles can be prevented at the corner. In this case, both the scrolls are engaged with each other at the same positions thereof as in the conventional one, and thus the performance is at a level similar to that of the conventional one.

(ii) Each round having a curvature radius $\rho$ is present at each corner of the inside end base portion of the lap and the inside surface of the side plate and is provided with compressive residual stress by blowing solid grains thereon, and fatigue strength at the rounded portion is heightened about 65% more than that of the conventional one, together with the increse in its surface hardness. Therefore, the fluid machine of the present invention can prevent cracks and breakage troubles from occurring at the corners of the inside end base portions of the laps. Further, since the portions where the scroll members are engaged with each other are mechanically finished in the same way as in the conventional one, it can be avoided that a fluid in the sealed chambers leaks out therefrom. Accordingly, the performance of the fluid machine does not deteriorate.

(II) At a stress concentration position in each scroll member, i.e., at the corner of the base of the lap and the inside surface of the side plate, the relatively large round can be roughly formed which is sufficient to ensure the lap with fatigue strength, and finishing another round can be accomplished in a simple manner of cutting each corner portion of the lap by the use of a finishing cutter after the rough working. Therefore, the number of the working hours is not increased and the productivity can be improved.

Further, after the rough working, the above-mentioned round can be formed at each corner portion, and this round has the relatively small curvature radius which does not contact with the tip end portion of the lap of the partner scroll member. Therefore, the scroll type fluid machine of the present invention can prevent the fluid from leaking out through the sealed chambers. In consequence, it can be avoided that its performance deteriorates.

BRIEF DESCRIPTION OF THE DRAWINGS

FIG. 1 is a partial perspective view illustrating an inner end portion of a lap of a scroll member, and FIG. 2 is a partial section taken along the line II—II in FIG. 1;

FIG. 3 is a partial perspective view illustrating the inner end portion of the lap of the scroll member, and FIG. 4 is a partial section taken along the line IV—IV in FIG. 3;

FIG. 5 is a perspective view illustrating the inner end portion of the lap of the scroll member, FIG. 6 is a sectional view taken along the line VI—VI in FIG. 5, and FIG. 7 is a sectional view illustrating an engaging state of the pair of scroll laps in the vicinity of the inner end portion of the lap in FIG. 5;

FIGS. 8 and 9 show a fourth embodiment of the present invention; FIG. 8 is a perspective view of the lap of the scroll member, and FIG. 9 is a sectional view taken along the line IX—IX in FIG. 8;

FIGS. 10 and 11 show a fifth embodiment of the present invention; FIG. 10 is a partial perspective view illustrating the eddy center of the spiral lap of the scroll member, and FIG. 11 is a partial section taken along the line XI—XI in FIG. 10;

FIGS. 12 and 13 show a sixth embodiment of the present invention; FIG. 12 is a partial perspective view of the eddy center of the spiral lap of the scroll member, and FIG. 13 is a partial section taken along the line XIII—XIII in FIG. 12;

FIG. 14 is a diagram comparing the present invention with a conventinal one in fatigue strength;

FIG. 15 is a partial perspective view illustrating the eddy center of the spiral lap of the scroll member after the finish working, FIG. 16 is a sectional view taken along the line XVI—XVI in FIG. 15, FIG. 17 is a partial perspective view illustrating the eddy center of the spiral lap of the scroll member after rough working, and FIG. 18 is a sectional view taken along the line XVIII—XVIII in FIG. 17;

FIG. 19 is a sectional view taken along the line XIX—XIX in FIG. 20, FIG. 20 is a sectional view taken along the line XX—XX in FIG. 19, and FIG. 21 is an enlarged section illustrating an angular portion at the corner of a base of the lap and an inside surface of a side plate;

DESCRIPTION OF THE PREFERRED EMBODIMENT

EMBODIMENT 1

The first embodiment of the present invention will be described in detail in reference to FIGS. 1 and 2.

Figure 1:
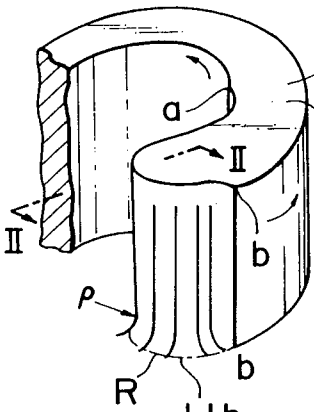
FIGS. 1 and 2 show a first embodiment of the present invention.
Figure 2:
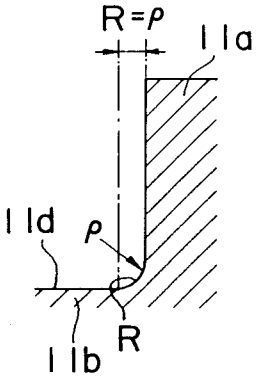
Figure 3:
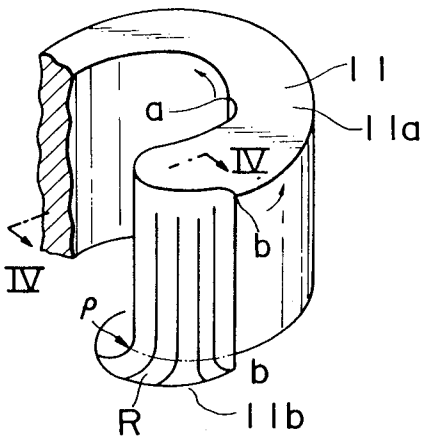
FIGS. 3 and 4 show a second embodiment of the present invention.
Figure 4:
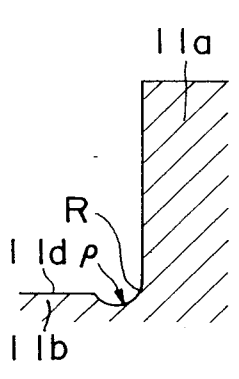

Referring to FIGS. 1 and 2, numeral 11 is a scroll member, and numeral 11*a* is a spiral lap which is prepared integrally on an inside surface 11*d* of a side plate 11*b* by means of casting, forging or injection molding. Contact surfaces extending outwardly from points a and b may be finally finished in a mechanical manner, and in this connection, the above-mentioned contact surfaces are the portions where the laps 11*a* of a pair of scroll members are engaged with each other. On the contary, a leading nose section extending between the points a and b at an inner end portion (an end portion at an eddy center of the spiral lap) of the lap 11*a* is not finished mechanically, and a round at the corner of the base of the lap 11*a* and the inside surface 11*d* of the side plate 11*b*, i.e., a round already formed on a scroll stock is left as it is there.

In this way, the round R having a radius $\rho$ is formed only at the corner of the inner end portion of the lap 11*a* and the inside surface 11*d* of the side plate 11*b*.

As a result, it can be avoided that stress concentrates at the corner of the inner end portion of the lap 11*a* and the inside surface 11*d* of the side plate 11*b*, and the occurrence of the cracks and breakage troubles can be prevented at this corner.

Figure 22:
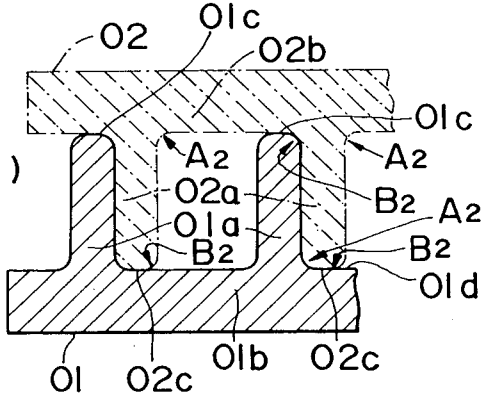
FIG. 22 is a sectional view illustrating an engaging state of the lap having rounded angular portions A with the other lap having rounded end portions B of the partner scroll.

As described above, the position where the round R having the radius $\rho$ is formed is only the inner end portion of the lap, and it is thus unnecessary to form the rounds on base portions $A_2$ and tip portions $B_2$ of the laps as exhibited in FIG. 22. Therefore, the above-mentioned object of the present invention can be accomplished by an extremely simple manufacturing method.

The aforesaid points a and b of the inner end portion (the end portion at the eddy center of the spiral lap) may be positioned arbitrarily within "involute curve-effective limit points which depend upon a parameter $\beta$" which is suggested in, for example, Japanese Patent Application No. 111658/1984 (U.S. Ser. No. 738,049 filed May 24, 1985).

This theory will be described by quoting from this Japanese patent application, and FIG. 25 attached hereto is quoted from FIG. 1 of the aforesaid Japanese application.

Figure 25:
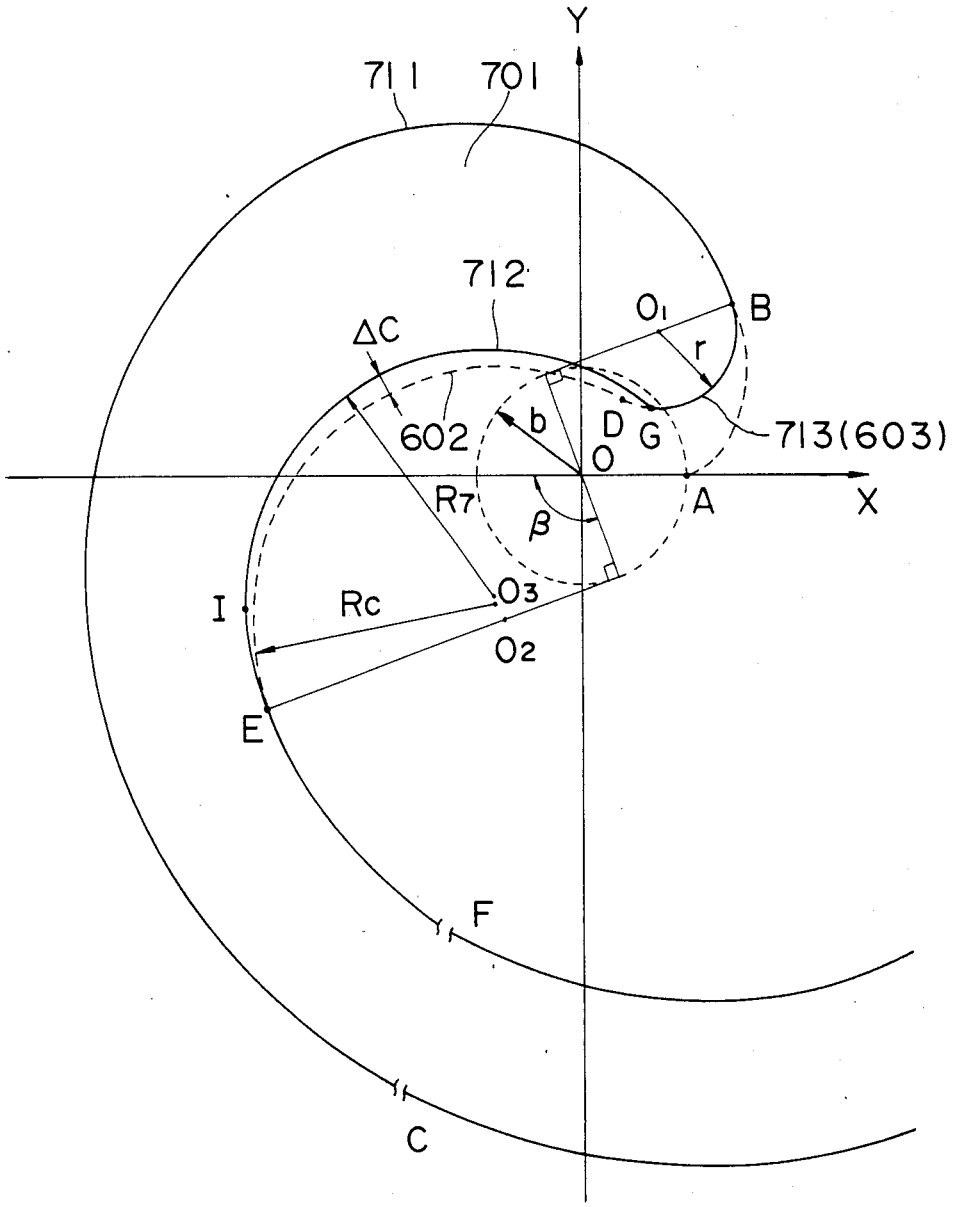
FIG. 25 Prior Art
FIG. 25 is a front view illustrating the spiral lap which has been suggested in Japanese Pat. No. 111658/1984.

Referring to FIG. 25, there is shown a stationary spiral element 701, and reference numerals 711 and 712 are an outer curve and an inner curve, respectively.

It is seen that the outer curve 711 is an involute curve having a starting point A and that a base circle of a radius b, a curvilinear section E–F of the inner curve 712 is of an involute curve having an angular shift of $(\pi-\lambda/b)$ with respect to the outer curve 711. It is also seen that a curvilinear section E–I is of an arc having the same radius Rc as the radius of an end milling cutter, and that a section I–G is an arc having a center $O_3$ and a radius $R_7$. There is shown a connection curve 713 which is of an arc having a radius r and which joints smoothly the outer curve 711 and the inner curve 712.

A point B is a boundary point existing between the outer curve 711 and a connection curve 713, where these curves may share an identical tangential line. It is seen that it is of an involute curve in the area outside of the point B (on the point C's side), while it becomes an arc in the area inside of the point B (on the point G's side).

The point A is the starting point of the outer curve 711, the point C is an arbitrary point existing in the area sufficiently outside of the outer curve 711, and the point F is an arbitrary point existing in the area sufficiently outside of the inner curve 712. The point G is a point of intersection between the arc having a radius $R_7$ in the inner curve 712 and the connection curve 713, and this point may be on an arbitary position on an arc having a radius r in the range D–B.

Also, it is notable that this dimensional relationship may hold good in the case of the revolving spiral element.

Now, the radii $R_7$ and r may be given with the following equations; that is $$R_7=\lambda+b\beta+d$$

$$r=b\beta+d$$

where $\lambda$ is the radius of revolutionary motion;

b is the radius of a base circle;

$$d=\frac{b^2-(\lambda/2+b\beta)^2}{2(\lambda/2+b\beta)} \text{ and}$$

$\beta$ is a parameter, which represents a marginal range for the choice of an involute curve.

It is seen that a straight line passing the origin O and defined at the angle of $\beta$ with respect to the X-axis and the straight line $EO_2$ and the extension of the straight line $BO_1$ intersect orthogonally with each other, and that the straight line segments $EO_2$ and $BO_1$ are in parallel with each other.

According to the configuration of the spiral element mentioned above, it is noted that when installed in position, the point F on the involute curve at an arbitrary point sufficiently outside of the inner curve of the stationary spiral element 701 will come to contact with the corresponding point on the involute section of the outer curve on the part of the revolving spiral element (not shown), which point of contact will shift gradually radially inwardly as the revolving spiral element moves in revolution. And the point of contact is shifting to the point E on the inner curve 712 of the stationary spiral element 701, contacting with the corresponding point on the outer curve of the revolving spiral element (the same point as the point B on the part of the stationary spiral element). As the revolutionary motion of the spiral element continues still further, it is seen that the both elements are now caused to be moved with a gap of $\Delta C$ defined between the curvilinear section E–D–G of the curve 602 and the section E–I–G of the curve 712.

Therefore, it is notable that the contact engagement between the both spiral elements at the central leading ends thereof will continue till it reaches the point E (in contact with the point B on the complementary spiral element), therefore a small gap of $\Delta C$ existing between the two in mutual engagement.

That is to say, in the section between the involute curve-effective limit points E and B which are dependent upon the parameter $\beta$, constitution is made so that a small clearance may be present between the spiral members.

Figure 21:
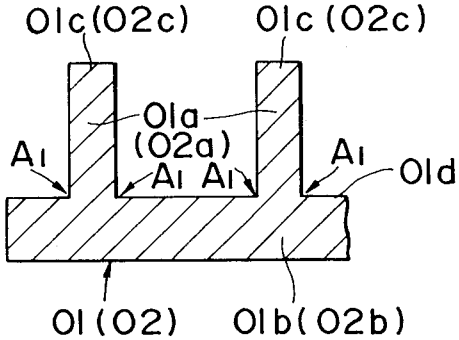
FIG. 21 PRIOR ART

The points a and b (in FIG. 1) in each scroll member according to the present invention are arranged at suitable positions within the above-mentioned points E and B, and the portions which extend outside the points a and b (on the side of the involute curve) of the scroll member have the same right angle corners $A_1$ as in FIG. 21. This constitution permits accomplishing a proper engagement of both the spiral members and providing a good performance, and since both the spiral members are not in contact with each other between the points a and b, the suitable rounds can be formed at bases of the laps. Further, the portions where both the scrolls engage with each other are finished by the same final working as in the conventional one, and thus the performace is also the same as in the conventional one.

Needless to say, the corner portions of scroll stocks can be rounded by a mechanical working, as exhibited in FIGS. 1 and 2.

EMBODIMENT 2

Next, Embodiment 2 of the present invention will be described.

In Embodiment 1 just described, the round R having the shape of the recess, which has been formed at the corner of an inner end base portion of the lap 11*a* and the inside surface 11*d* of the side plate 11*b* of the scroll stock, may be left as it is there.

Alternatively, instead of leaving the recess-shaped round which has been formed on the stock, the corner portion may be rounded in the form of the recess by mechanically working the stock.

EMBODIMENT 3

Figure 24:
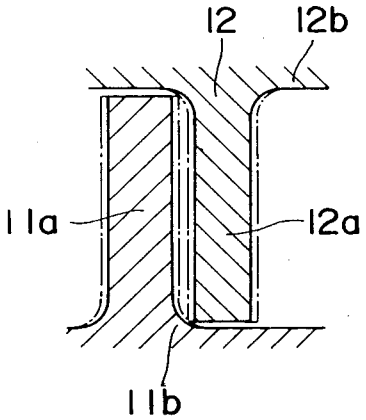
FIG. 24 is a sectional view illustrating an engaging state of the inner end portions of the pair of scroll laps one of which is shown in FIG. 1.
Figure 23:
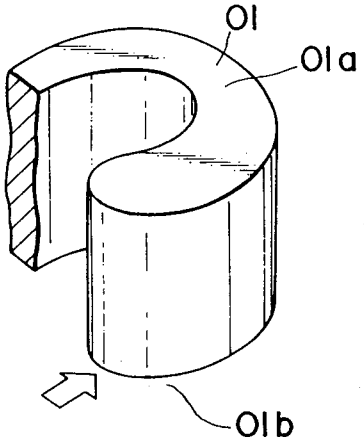
FIG. 23 PRIOR ART
FIG. 23 is a perspective view of the inner end portion of the lap of the conventional scroll.
Figure 20:
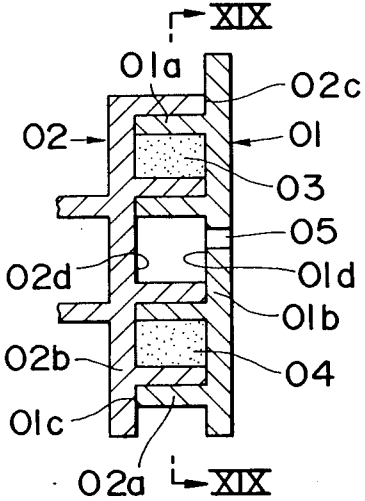
FIG. 20 PRIOR ART

According to Embodiment 1 given above, as shown in FIG. 24 (the sectional view illustrating the engaging condition of both the scrolls in the section between the points a and b in FIG. 1), the round portion R is brought into contact with the tip end portion of the partner lap (which is shown by a onedot chain line in FIG. 24), since the lap has a right angle edge and an intact large wall thickness. Therefore, together with the formation of the round R at the corner portion, it is necessary to decrease the wall thickness of the laps of both the scrolls in compliance with the formed R, though a little decline in strength occurs owing to the decreased wall thickness.

In FIG. 24, the lap and the side plate of the partner scroll member 12 are represented by reference numerals 12*a* and 12*b*, respectively.

In view of such situations, the rounds R are formed between the points a and b in the vicinity of the inner end base portions of the laps of both the scrolls, and also on the corresponding tip portions of the laps of both the scrolls, the rounds R are left as they are, or beveling is carried out so that these tip portions may not contact with the rounds R at the base portions of the laps.

Embodiment 3 of the present invention will be described in detail in reference to FIGS. 5 to 7.

Figure 5:
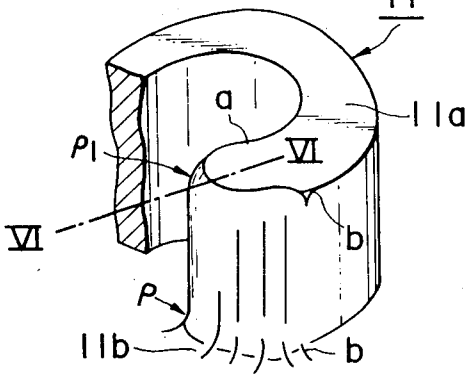
FIGS. 5 to 7 show a third embodiment of the present invention.
Figure 6:
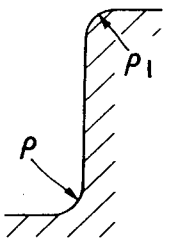
Figure 7:
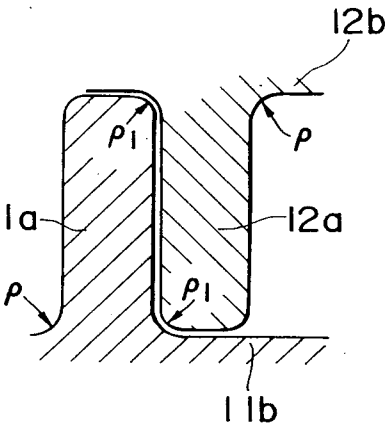

Referring to FIGS. 5 to 7, reference numeral 11 is a scroll body, and numerals 11*a* and 11*b* are a lap and a side plate, respectively. Rounds R having radii of $\rho$, $\rho_1$ are formed on the base and the tip of the lap only in the region between points a and b at an inner end portion of the lap 11*a* where both the scroll members are not engaged with each other. As for the tip of the lap, beveling may be carried out. Sizes of the round R and the beveling are suitably decided so that both the scrolls may not contact with each other when driven. The partner scroll member is constituted similarly. By working in such a way, the laps 11*a*, 12*a* are engaged in the region between the points a and b in FIG. 5 as shown in a sectional view of FIG. 7. In this case, the round R having the radius of $\rho$ is formed at the corner of the lap and the side plate without reducing the wall thickness of the inner end portion of the lap at all, with the result that the strength of the lap can be improved as much as an amount based on the formation of the round R at the corner. Further, the portions where both the scroll members are engaged with each other are the same as in the conventional one, and thus the performance is also similar to that of the conventional one.

EMBODIMENT 4

In FIG. 2 regarding Embodiment 1, it is suggested to form the large round R at the base of the inner end portion of the lap of the scroll member. Now, in order to form the above-mentioned large round R at the base of the central lap with the intention of minimizing a remaining fluid volume at the end of the discharge process, it is contrived (1) to reduce the wall thickness of the lap as much as an amount corresponding to the round R, and (2) to bevel the tip of the lap so that it may not contact with the round R at the base of the lap. However, the concept (1) will render its strength poor and the concept (2) will increase costs disadvatageously because of using a cutter having a peculiar shape.

For these reasons, the wall thickness of the lap is reduced as much as an amount corresponding to $\frac{1}{2}$ of the original R in order to prevent the round R at the inner end base portion of the scroll lap from contacting with the partner scroll member.

Embodiment 4 of the present invention will be described in detail in reference to FIGS. 8 and 9.

Referring to FIGS. 8 and 9, numeral 11 is a scroll body, and numeral 11*a* is a lap of the scroll body 11. At a high stress generation area, i.e., at the base of an inner end of the lap 11*a*, a round R is formed which is the same as the round R shown in FIG. 2 regarding Embodiment 1. The wall thickness of the lap is decreased as much as an amount corresponding to $\frac{1}{2}$ of the round R. Reference numeral 11*b* is a side plate of the scroll body 11.

Such a constitution permits minimizing the reduction in the wall thickness of the lap and preventing stress from concentrating at the base of the lap.

Since the wall thickness of the lap is reduced by an amount corresponding to $\frac{1}{2}$ of R with the aim of preventing the round R at the base of the inner end portion of the lap from contacting with the partner scroll, the decline in the wall thickness of the lap can be minimized, which fact permits manufacturing the scroll lap the strength of which is less lost.

EMBODIMENTS 5 AND 6

Embodiments 5 and 6 of the present invention will be described in detail in reference to drawings.

In FIGS. 10 and 11, Embodiment 5 is shown. A scroll member 11 which is equipped with a spiral lap 11*a* and a side plate 11*b* is integrally molded by rough working such as forging, casting or injection molding. In this case, at an inner end portion of the lap 11*a*, i.e., at a corner portion of the lap 11*a* and the side plate 11*b* in a region between points a and b at which the lap will begin to contact with the lap of the partner scroll, a round R having a curvature radius of $\rho$ is formed. Afterward, onto the round R of the scroll member which is an unfinished stock, a mixture including solid grains is blown which is prepared by mixing, with a liquid, the solid grains such as steel balls, glass beads or abrasive grains each having a curvature radius of $\rho$ or less. The portions other than the above solid grainsblown portion of the lap and the whole of the side plate are then finished by means of a mechanical working. The treatment of blowing the solid grains may be carried out after the mechanical working.

In Embodiment 6, as shown in FIGS. 12 and 13, a recess may be formed in the side plate at the base of the inner end portion of the lap 11*a* in molding the scroll member integrally, whereby a round $R_0$ having a curvature radius $\rho$ is formed at the corner of the lap 11*a* and the side plate 11*b*.

According to Embodiment 5, the round having a curvature radius of $\rho$ is present at the corner of the inner end portion of the lap and the side plate, and this round is provided with compression residual stress by the blow of the solid grains. Further, fatigue strength at the round portion is heightened together with the increase in surface hardness. FIG. 14 shows a ratio of the fatigue strength of the scroll member PS in the present embodiment to that of a conventional scroll member CS. The results shown therein are obtained under the conditions that a material for the scroll members is an aliminum alloy casting, a used test machine is a Schenk type plane bending fatigue testing machine, a repeated velocity of the test is 1800 cpm, and an ambient temperature is ordinary temperature.

According to these results, the fatigue strength at the above-mentioned round formed in this embodiment is improved about 65% more than that of the conventional one, and at the inner end portion of the lap, the generation of cracks and breakage troubles is restrained.

EMBODIMENT 7

Embodiment 7 of the present invention will be described in detail in reference to drawings.

Figure 15:
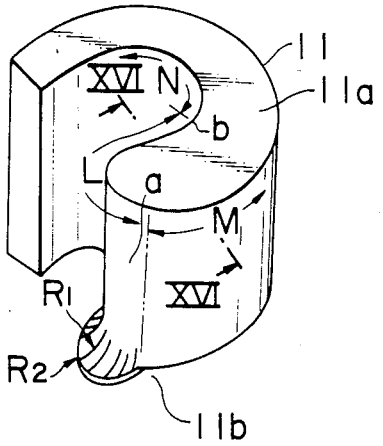
FIGS. 15 to 18 show a seventh embodiment of the present invention.
Figure 16:
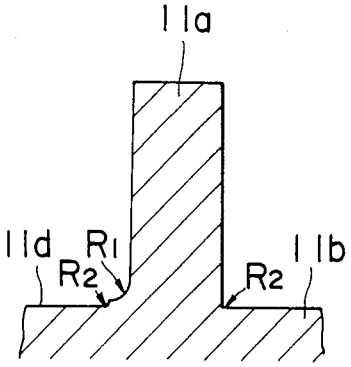
Figure 17:
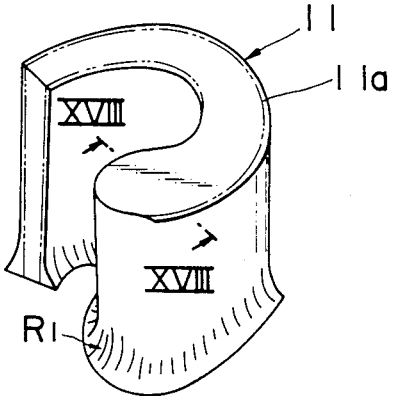
Figure 18:
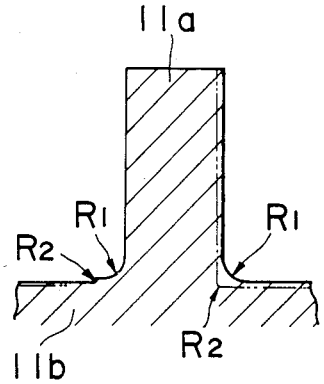
Figure 19:
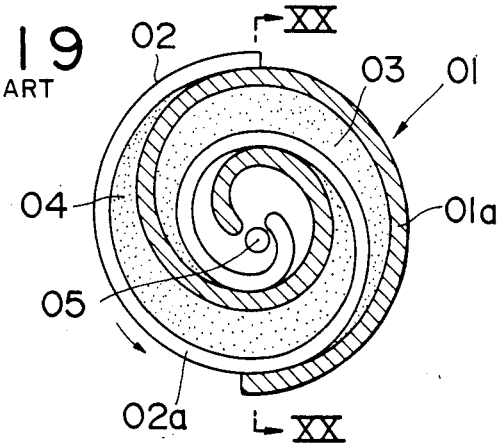
FIG. 19 PRIOR ART
FIGS. 19 to 21 show a conventional scroll member.

As shown in FIGS. 17 and 18, a complete round having a relatively large curvature radius $R_1$ which is enough to provide a lap 11*a* with fatigue strength is roughly formed at a corner of at least an inner end base portion of the lap 11*a* and an inside surface 11*d* of a side plate 11*b* of a scroll member 11 by the use of an end milling cutter. Afterward, as shown in FIGS. 15 and 16, a relatively small round having a curvature radius $R_2$ which will not contact with a tip end portion of the lap of the partner scroll member is formed, by the end milling cutter, at a corner of the base of the lap 11*a* and the inside surface 11*d* of the side plate 11*b* within peripheral ranges M and N placed outside points a and b of the lap 11*a* of the scroll member 11, and the above-mentioned ranges M and N are sections which will begin to contact with the lap of the partner scroll member. Further, within a range L between the points a and b, a position of the inside surface 11*d* of the side plate 11*b* which is placed away from a side surface of the lap 11*a* is mainly cut by the end milling cutter, with the aforesaid round having the curvature radius of $R_1$ left at it is.

These working operations can be accomplished by using the end milling cutter for rough working a bit of which has the curvature radius of $R_1$ at its tip, and the end milling cutter for finish working a bit of which has the curvature radius of $R_2$ at its tip. Further, it is preferred that the curvature radius $R_1$ is 10 times or more as much as the curvature radius $R_2$. At corners of the base portions other than the stress concentration portion, i.e., the inner end portion of the lap 11*a* of the scroll member 11 and the inside surface 11*d* of the side plate 11*b*, a right angle configuration may be formed in a conventional manner, or the relatively small round having the curvature radius $R_2$ may be formed directly by means of the end milling cutter so that the aforesaid corner portions may not contact with the tip end portion of the lap of the partner scroll. If a wear-resistant bottom plate is disposed on the side plate of the scroll member, the tip of the bit of the end milling cutter for finish working should selectively have such a curvature radius $R_2$ as does not interfere with a curvature radius at an end portion of the bottom plate.

What is claimed is:

1. A scroll type fluid machine, comprising a pair of scroll members, each having a side plate and a spiral lap disposed upright on an inside surface of said side plate, said scroll members engaging each other and revolving with respect to each other in solar motion to form sealed chambers therebetween which are restricted by engagement of said scroll members to each other, the sealed chambers having changed in volume with rotation of said scroll members so that fluid taken into said sealed chambers due to said change in said volume can be varied and discharged, said scroll members each being formed in one piece, each lap having a base at its side plate which makes a corner with its side plate, each corner having a large radius of curvature between said base and said inside surface of said plate so that stress is not concentrated at said corner, said corner of one scroll member being spaced from the other scroll member by a small gap, said both spiral laps being respectively formed by an outer curve consisting of an involute curve having an inner arc of a radius R, and a connection curve having an arc of a radius r and connecting said outer curve and said arc having the radius R in a smooth manner, and $\lambda$ is the radius of the revolutionary motion between said scroll members and b is the radius of a base circle of said involute curve, said gap being selected so that said inner curve and said connection curve between the marginal points of said involute curve determined with a parameter $\beta$ cannot come in contact with each other, in accordance with the equations:

$$R = \lambda + b\beta + d$$

$$r = b\beta + d$$

$$d = \frac{b^2 - \left(\frac{\lambda}{2} + b\beta\right)^2}{2\left(\frac{\lambda}{2} + b\beta\right)}.$$

2. A scroll type fluid machine, comprising a pair of scroll members, each having a side plate and a spiral lap disposed upright on an inside surface of said side plate, said scroll members engaging each other and revolving with respect to each other in solar motion to form sealed chambers therebetween which are restricted by engagement of said scroll members to each other, the sealed chambers having changed in volume with rotation of said scroll members so that fluid taken into said sealed chambers due to said change in said volume can be varied and discharged, said scroll members each being formed in one piece, each lap having a base at its side plate which makes a corner with its side plate, each corner having a large radius of curvature between said base and said inside surface of said plate so that stress is not concentrated at said corner, said radius of curvature between said base and said inside surface for each of said scroll members being made by blowing into the corner of each lap, solid particles each having a radius smaller than said radius of curvature so that said radius of curvature is formed and for imparting compression residual stress to said corner of each scroll member.

3. A scroll type fluid machine, comprising a pair of scroll members, each having a side plate and a spiral lap disposed upright on an inside surface of said side plate, said scroll members engaging each other and revolving with respect to each other in solar motion to form sealed chambers therebetween which are restricted by engagement of said scroll members to each other, the sealed chambers having changed in volume with rotation of said scroll members so that fluid taken into said sealed chambers due to said change in said volume can be varied and discharged, said scroll members each being formed in one peice, each lap having a base at its side plate which makes a corner with its side plate, each corner having a large radius of curvature between said base and said inside surface of said plate so that so that stress is not concentrated at said corner, each scroll member including a rounded leading nose section at an inside end thereof, each lap having an inner curved surface and an outer curved surface extending away from said leading nose section thereof, said leading nose section being indented inwardly with respect to said inner and outer curved surfaces and carrying said base with said curved corner.

4. A scroll type fluid machine according to claim 3 wherein said radius of curvature between said base and said inside surface for each of said scroll members is made by blowing into the corner of each lap, solid particles each having a radius smaller than said radius of curvature so that said radius of curvature is formed and for imparting compression residual stress to said corner of each scroll member.

5. The scroll type fluid machine as claimed in claim 4, wherein said corner of one scroll member is spaced from the other scroll member by a small gap said both spiral laps being respectively formed by an outer curve consisting of an involute curve having an inner arc of a radius R, and a connection curve having an arc of a radius r and connecting said outer curve and said arc having the radius R in a smooth manner, and λ is the radius of the revolutionary motion between said scroll members and b is the radius of a base circle of said involute curve, said gap being selected so that said inner curve and said connection curve between the marginal points of said involute curve determined with a parameter $\beta$ cannot come in contact with each other, in accordance with the equations:

$$R = \lambda + b\beta + d$$

$$r = b\beta + d$$

$$d = \frac{b^2 - \left(\frac{\lambda}{2} + b\beta\right)^2}{2\left(\frac{\lambda}{2} + b\beta\right)}.$$

* * * * *